US007275590B2

(12) United States Patent
McClain

(10) Patent No.: US 7,275,590 B2
(45) Date of Patent: Oct. 2, 2007

(54) SUBMERSIBLE PUMP

(76) Inventor: Jim McClain, 43873 Barbara Trail, Aguanga, CA (US) 92536

( * ) Notice: Subject to any disclaimer, the term of this patent is extended or adjusted under 35 U.S.C. 154(b) by 642 days.

(21) Appl. No.: 10/854,862

(22) Filed: May 27, 2004

(65) Prior Publication Data

US 2005/0265874 A1 Dec. 1, 2005

(51) Int. Cl.
*E21B 43/00* (2006.01)

(52) U.S. Cl. ..... 166/68.5; 166/105

(58) Field of Classification Search ..... 166/68, 166/68.5, 105, 369, 372
See application file for complete search history.

(56) References Cited

U.S. PATENT DOCUMENTS 5,915,475 A 6/1999 Wells et al.
6,089,322 A * 7/2000 Kelley et al. ..... 166/370
6,237,691 B1 5/2001 Kelley et al.

* cited by examiner

*Primary Examiner*—William P Neuder
(74) *Attorney, Agent, or Firm*—Calif Tervo Palomar Patent

(57) ABSTRACT

A submersible pump for attachment to the lower end of a well pipe discharge tube for insertion in liquid includes a stationary collecting tube for collecting the liquid and an upward and downward reciprocating pumping tube within the collecting tube for pushing and lifting the liquid into the discharge tube; source of pressurized gas, a casing assembly including a casing tube and a gas valve, and a piston assembly with the casing tube including a piston tube having a lower end connected to the pumping tube for reciprocating the pumping tube and an upper portion having pistons for moving in chambers with the inside of the casing tube. Preferably the same amount of liquid is pumped during the upward movement of the pumping tube as during the downward movement.

25 Claims, 4 Drawing Sheets

FIG. 5A
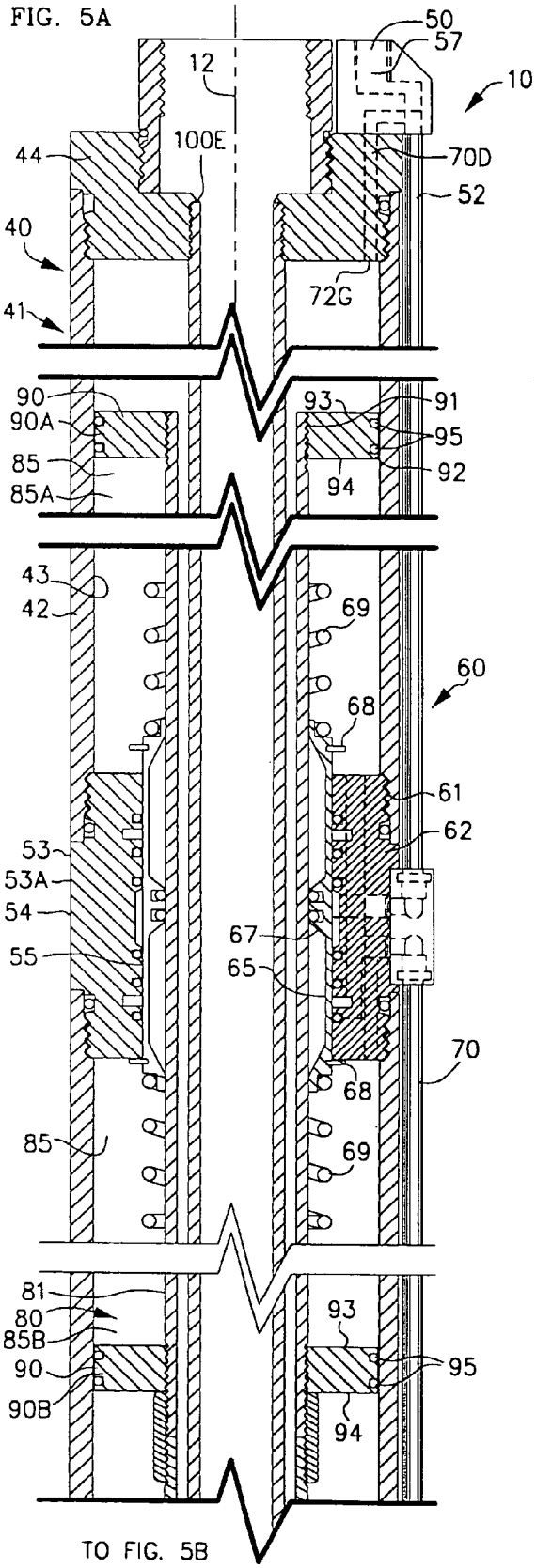
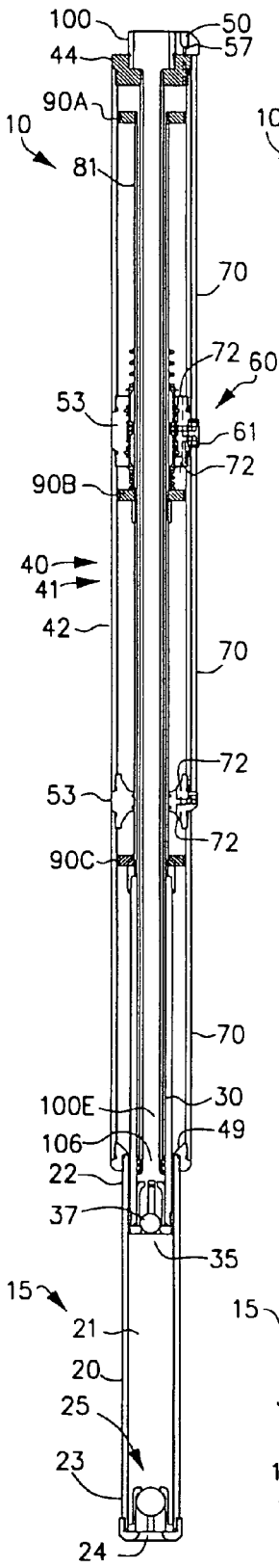
FIG. 2
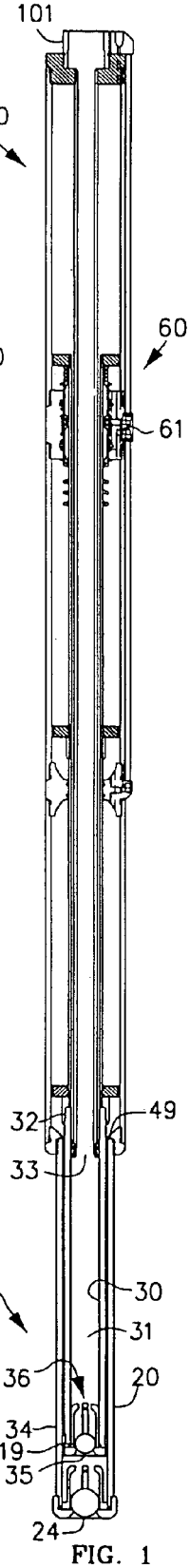
FIG. 1

SUBMERSIBLE PUMP

CROSS-REFERENCE TO RELATED APPLICATIONS

This application claims the benefit of U.S. Provisional Application No. 60/458,019, filed Mar. 28, 2003.

FIELD OF THE INVENTION

This invention relates to a submersible pump and more specifically to a pneumatic or gas driven pump.

BACKGROUND OF THE INVENTION

There are two main conventional approaches to pumping liquid from a deep well. One, the pump is placed in the bottom of the well, or, two, the main body of the pump is at the surface and a long shaft drives a pump mechanism at the bottom of the well. Both approaches have shortcomings, especially for very deep wells. The first method is generally restricted to very small pumps that can only pump a very limited height and the second method, such as used in oil wells, involves moving large masses of connecting rods, which requires huge and costly equipment and results in inefficiencies.

Many conventional pumps use a bottom piston located close to the liquid intake. The piston moving up and down affects the liquid level in the well and agitates sand and other abrasive materials that are then more likely to enter and damage the pump.

SUMMARY OF THE INVENTION

The invention is a submersible pump for attachment to the lower end of a well pipe for insertion down a well, inside of the well casing, and for pumping a liquid into the entrance of the discharge tube. The pump generally includes a wet portion for disposition in the liquid, including a stationary collecting tube for collecting the liquid and a reciprocating pumping tube within the collecting tube for pushing and lifting the liquid into the discharge tube; and reciprocating means for reciprocating the pumping tube.

Preferably the same amount of liquid is pumped during the lifting movement as during the pushing movement and the force and time required for in the lifting movement and pushing movement are about equal.

The reciprocating means includes a pressurized gas source for supplying a pressurized gas, a casing assembly including a casing tube, one or more gas seals connected to said casing tube, and a gas valve, and a piston assembly with the casing tube including a piston tube having a lower end connected to the pumping tube for reciprocating the pumping tube and an upper portion having pistons for moving in chambers with the inside of the casing tube.

The gas valve has a first position directing pressurized gas to lift the pistons and exhaust gas from atop the pistons and a second position directing pressurized gas to lower pistons and exhaust gas below the pistons.

The features and advantages of the invention will be readily understood when the detailed description thereof is read in conjunction with the accompanying drawings wherein like reference numerals refer to like parts throughout.

BRIEF DESCRIPTION OF THE DRAWINGS

FIG. 1 is a vertical cross sectional view of a first preferred embodiment of the pump of the invention with the pumping tube in the lower position.

FIG. 2 is a vertical cross sectional view of the pump of FIG. 1 with the pumping tube in the upper position.

FIG. 5A is an enlarged partial vertical cross sectional view of the upper portion of the pump of FIG. 3.

DETAILED DESCRIPTION OF THE INVENTION

Figure 3:
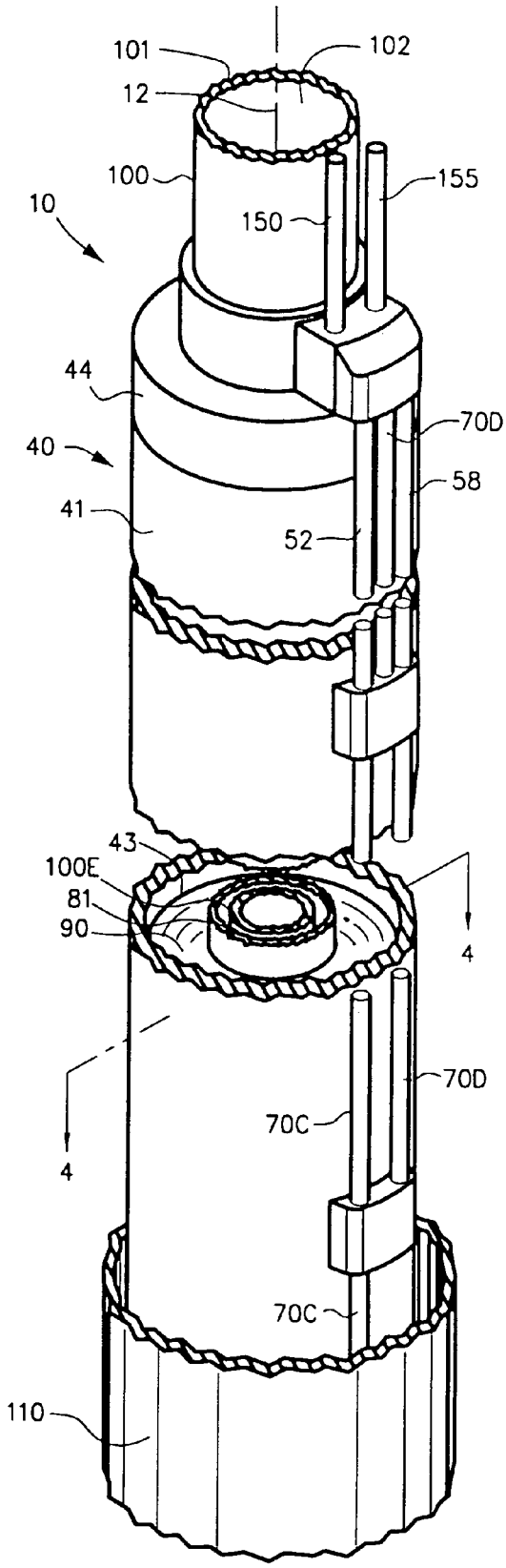
FIG. 3 is an enlarged partially cut away perspective view of a second embodiment of the pump further including its immediate environment.
Figure 4:
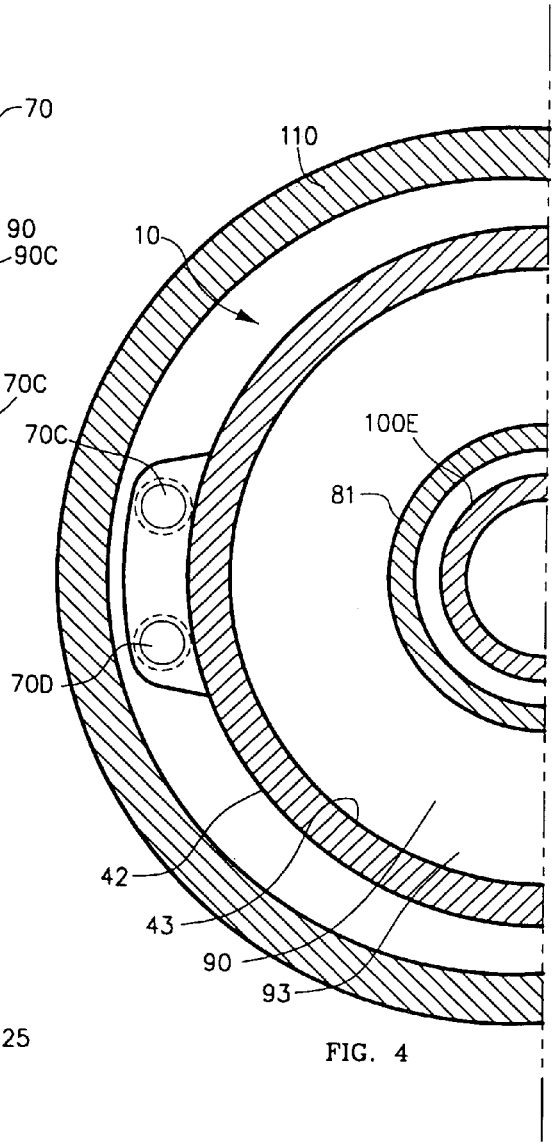
FIG. 4 is half of the sectional view of the pump taken on line 4-4 of FIG. 3.

With reference now to the drawings and more particularly FIGS. 1-5 thereof; FIG. 1 is a vertical cross sectional view of a preferred embodiment of the pump 10 of the invention with the pumping tube 30 in the lower position; FIG. 2 is a vertical cross sectional view of pump 10 with pumping tube 30 in the upper position; FIG. 3 is an enlarged partially cut away perspective view of a second embodiment of pump 10 further including its immediate environment; and FIG. 4 is half of the sectional view of pump 10 taken on line 4-4 of FIG. 3. FIG. 5A is an enlarged partial vertical cross sectional view of the upper portion of pump 10. FIG. 5B is an enlarged partial vertical cross sectional view of the lower portion of pump 10.

As shown in FIGS. 3 and 4, pump 10 is particularly designed for use in an upright or vertical orientation so as to be self-cleaning and long lasting. Pump 10 is typically connection to the lower end 104 of a liquid discharge tube 100, such as a well pipe, for insertion down a well casing 110 and into the liquid therein. Consequently, pump 10 is typically used in the vertical orientation shown in the drawings, and, in the Specification and claims, the terms "upper and lower" and "above and below" are used for convenience to describe relative directional reference in the common orientation of pump 10. However, it will be appreciated that pump 10 can be operated in other orientations, with modifications to the check valves. Therefore, terms such as "upper and lower" and "above and below" as used herein are meant in the relative sense and not the absolute sense.

Pump 10 generally comprises a wet portion 15 for disposition in the liquid, such as well casing 110, comprising a liquid collecting tube 20 and a pumping tube 30, and reciprocating means 40 for reciprocating movement of pumping tube 30 comprising a gas intake port 50 for supplying pressurized gas, such as air, a gas exhaust port 57, a casing assembly 41 including a casing tube 42, and a piston assembly 80 including a piston tube 81 with pistons 90. Tubes 20, 30, 42, 81 have a common longitudinal axis 12 and would typically be of circular lateral cross section but could have other shapes.

Casing tube 42 includes a lower end 49 and an upper end fitting 44 connected, such as by threads, to the lower end of standard discharge tube 100 and connected, such as by threads, to an extension tube 100E of discharge tube 100 within pump 10. It can be seen that pump 10 could be adapted for attachment over the standard discharge tube 100 without extension tube 100E. The invention will be described as if extension tube 100E is part of discharge tube 100. Discharge tube 100 includes an upper end, such as distal end 101 with an exit 102 for discharging liquid and a lower end, such as proximal end 104 including an entrance 106 for liquid.

Wet portion 15 collects and inserts liquid into discharge tube 100 as follows. Pump 10 may be entirely immersed in the liquid to be pumped or at least a portion of collecting tube 20 must be immersed. Looking primarily at FIG. 2, collecting tube 20 contains a collection chamber 21 for holding collected liquid, an open upper end 22 connected to lower end 49 of casing tube 42, and a lower end 23 including a collection port 24 and collection valve means 25, such as of well-known check ball type, having open and closed positions opening and closing said collection port 24 for permitting entry of liquid into collection chamber 21, but not exit from collection chamber 21, of the liquid in which collecting tube 20 is immersed. Looking at FIG. 5B, Collection valve 25 includes check ball 26, ball seat 29 and check cage 27, such as of multiple fingers 28. Check ball 26 is contained in check cage 27 and rises in check cage 27 as liquid pushes in through port 24 into collection chamber 21. Then, check ball 26 settles by gravity onto seat 29 so as to block exit of the collected liquid.

Figure 5B:
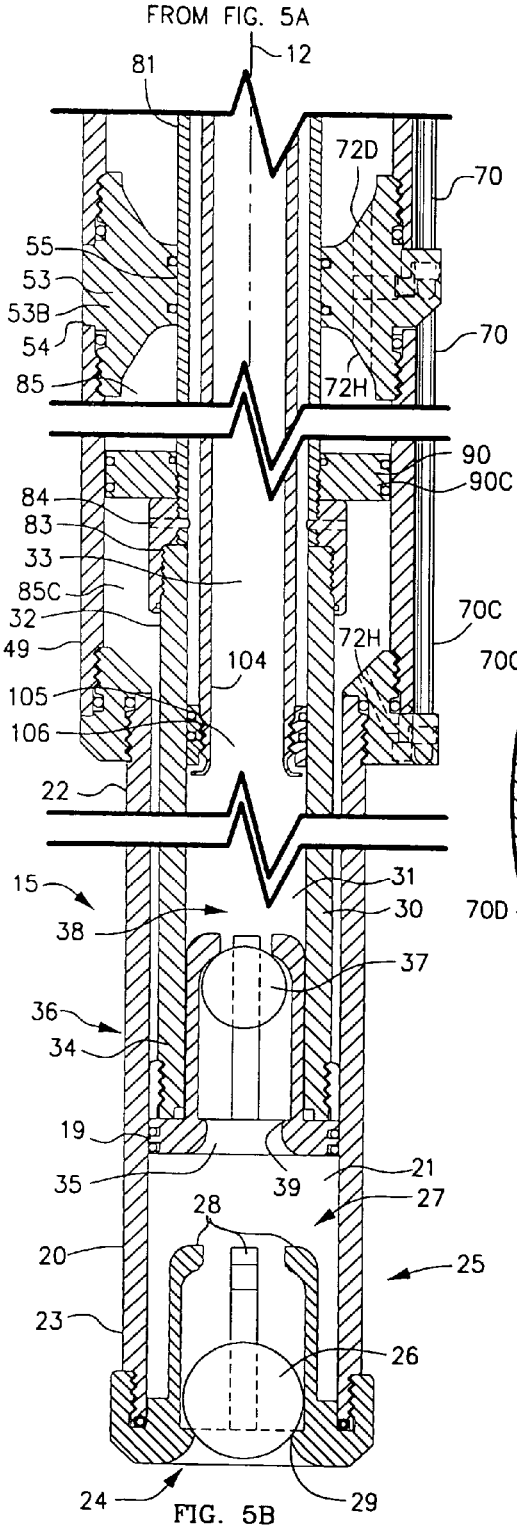
FIG. 5B is en enlarged partial vertical cross sectional view of the lower portion of the pump of FIG. 3.

Looking primarily at FIGS. 1 and 5B, pumping tube 30 is adapted for reciprocating, longitudinal, sealed, and sliding lifting and pushing movements with discharge tube 100 and with collecting tube 20. Pumping tube 30 slides over the end 104 of discharge tube 100. Pumping tube 30 for lifting liquid from collection chamber 21 has a lifting chamber 31 and an upper end 32 including an egress orifice 33 for egress of lifted liquid into discharge tube 100, and a lower end 34 including an ingress port 35 for ingress of liquid from collection chamber 21 and an ingress valve means 36, such as of well-known check ball type, having open and closed positions opening and closing said ingress port 35 for permitting entry into lifting chamber 21, but not exit from lifting chamber 21, of the liquid in collection chamber 21 as pumping tube 30 is lowered into collection chamber 21. Ingress valve means 36 includes check ball 37, ball seat 39 and check cage 38, such as of multiple fingers. Check ball 37 is contained in check cage 38 and rises in check cage 38 as liquid pushes in through port 35 into lifting chamber 31. Check ball 37 then settles by gravity onto seat 39 so as to block exit of the collected liquid. A sliding ring seal 19 seals between lower end 34 of pumping tube 30 and collecting tube 20 so as to prevent liquid in collection chamber 21 from escaping upward between tube 20 and tube 30.

The lifting movement of pumping tube 30 is from the lower position shown in FIG. 1, wherein pumping tube lower end 34 is within collecting tube 20 and distal liquid entrance 106 of discharge tube 100, with ingress valve 36 closed, to the upper position shown in FIG. 2, wherein pumping tube lower end 34 is proximal liquid entrance 106 such that a volume of liquid within lifting chamber 3 is lifted through liquid entrance 106 and fresh liquid flows into collection chamber 21 through collection port 24. The pushing movement is from the upper position, wherein collection valve 25 is closed, to the lower position such that a first volume of liquid is forced from collection chamber 21 through ingress port 35, through pumping tube 30, and into the liquid entrance 106 and a second volume of liquid from collection chamber 21 passes through ingress port 35 into lifting chamber 31. Preferably, pumping tube 30 is adapted for displacing a volume of collection chamber 21 during the pushing movement of approximately twice the volume of liquid lifted into the liquid entrance 106 during the lifting movement such that the first volume of liquid is approximately equal to the second volume of liquid. In this manner pump 10 is said to be "balanced" in that the same amount of liquid is pumped during the lifting movement as during the pushing movement and the force and time required for in the lifting movement and pushing movement are about equal. Ring seal 105 on the lower end 104 of discharge tube 100 slidingly seals between discharge tube 100 and pumping tube 30.

Gas intake port 50 is connected to a source of pressurized gas, such as by gas duct 150 connected to a compressor or pressure tank, not shown. Gas port 50 includes distribution duct 52 for distributing the received pressurized gas to gas valve means 60. Gas exhaust port 57 exhausts the gas such as by connection to an exhaust duct 155 for conducting the exhaust gas away form pump 10 such as to the surface for release or to a recycling tank for re-compression. Exhaust port 57 includes collection duct 58 connected thereto for transporting exhaust gas thereto.

One or more annular gas seals 53, such as gas seals 53A, 53B, 53C, have an outer radial side 54 connected to casing tube 42 and an inner radial side 55 in sealed sliding contact with piston tube 81. Gas seals 53 divide the cylindrical space between casing tube 42 and piston tube 81 into three piston chambers 85, such as first or upper, second or middle, and third or lower piston chambers 85A, 85B, 85C.

Piston assembly 80 includes piston tube 81 and pistons 90. Piston tube 81 is disposed around discharge tube 100 and is within and coaxial with casing tube 42. Piston tube 81 has a lower end 83 connected to upper end 32 of pumping tube 30 for reciprocating pumping tube 30. One or more toroidal, or annular, pistons 90, such as first, second, and third pistons 90A, 90B, 90C, each include a first radial wall, such as inner wall 91, connected to piston tube 81, a second radial wall, such as outer wall 92 including seals 95, such as piston rings, in sealed sliding contact with inner wall 43 of casing tube 42, an upper lateral face 93 and a lower lateral face 94. Each piston 90A, 90*b*, 90C resides in an associated piston chamber 85A, 85B, 85C.

Piston assembly 80 is adapted for reciprocating, longitudinal, sealed, and sliding movements with casing tube 42 including a lifting movement between a lower position and a higher position wherein pumping tube 30 is lifted and a pushing movement between the higher position and the lower position wherein pumping tube 30 is loaded with liquid.

Figure 8:
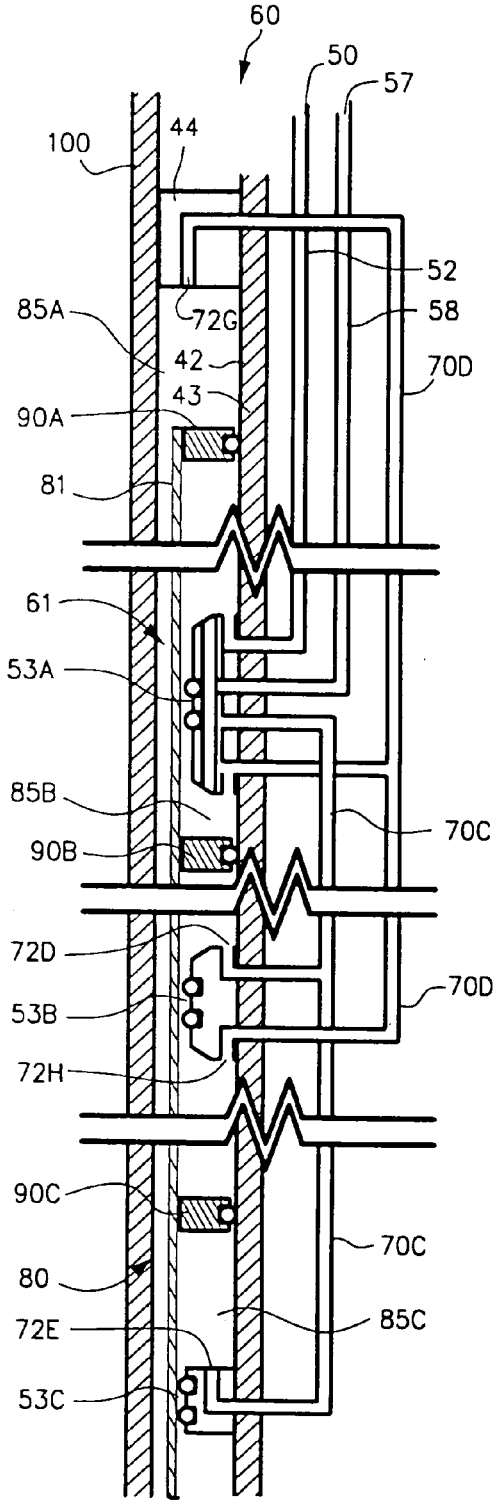
FIG. 8 is a schematic of the valve system of the pump of FIG. 3
Figure 6:
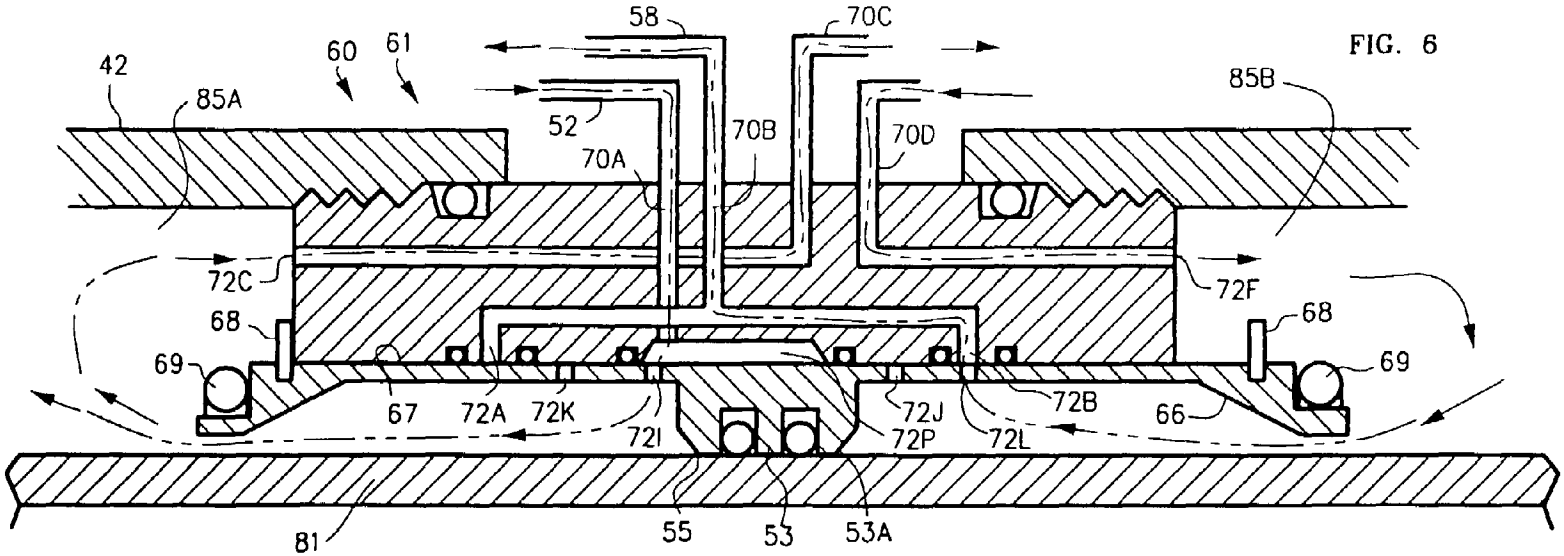
FIG. 6 is a schematic of a preferred embodiment of the valve in the first position.
Figure 7:
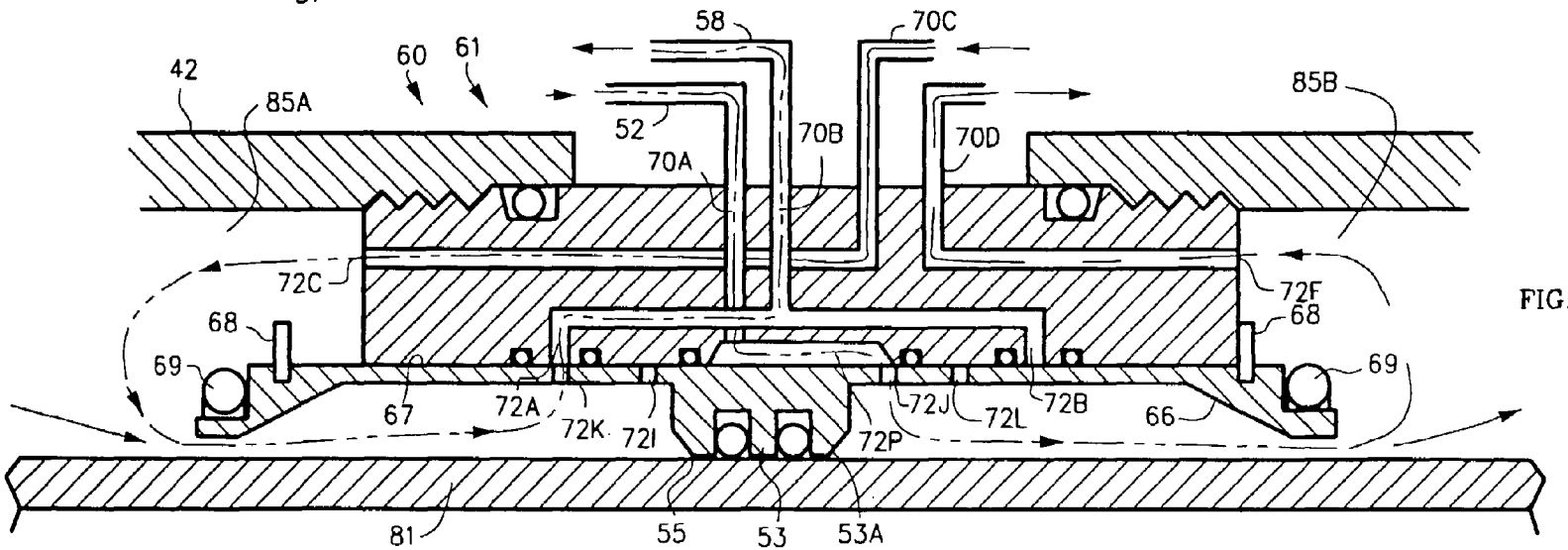
FIG. 7 is a schematic of the valve of FIG. 6 in the second position.

Looking also at FIGS. 6-8; FIG. 6 is a schematic of a preferred embodiment of valve 61 of valve means 60 in the lifting position. FIG. 7 is a schematic view of valve 61 of FIG. 6 in the loading position; and FIG. 8 is a schematic of gas valve means 60 of FIG. 3.

Gas valve means 60 is connected to casing tube 42, to pressurized gas port 50, such as by duct 52 for receiving pressurized gas therefrom and to exhaust port 57, such as by duct 58. Gas valve means 60 distributes pressurized gas to piston chambers 85 and removes exhaust gas from piston chambers 85 so as to reciprocate piston assembly 80 through the lifting movement and the pushing movement. Gas valve means 60 includes valve 61, and a plurality of gas ducts 70 for ducting gas to and from ports 72. Preferably, valve 61 is located between two piston chambers 85, such as between upper and middle piston chamber 85A, 85B, and is integral with gas seal 53A, as shown.

Gas Valve means 60 is movable between a first valve position, wherein said gas valve means 60 directs pressurized gas into chambers 85 below pistons 90 in the lower position to lift piston assembly 80 to the higher position and wherein gas valve means 60 exhausts gas from piston chambers 85 above pistons 90 during the lifting movement, and a second valve position, wherein said gas valve means 60 directs pressurized gas into piston chambers 85 above pistons 90 in the upper position to push piston assembly 80 to the lower position and wherein gas valve means 60 exhausts gas from piston chambers 85 below pistons 90 during the pushing movement.

Valve 61 generally comprises a body 62 and a slider assembly 65. Intake duct 70A ducts pressurized gas from duct 52 to pressure plenum or port 72P. Exhaust duct 70B ducts exhaust gas from exhaust ports 72A and 72B to collection duct 58. Duct 70C ducts gas between port 72C in lower end of piston chamber 85A below piston 90A and port 72D in lower end of piston chamber 85B below piston 90B and port 72E in lower end of piston chamber 85C below piston 90C. Duct 70D ducts gas between port 72F in upper end of piston chamber 85B and port 72G in upper end of piston chamber 85A above piston 90A and port 72H in upper end of chamber 85C above piston 90C Slider assembly 65 generally includes a slider 66, slider stop 68 and upper and lower springs 69. Slider 65 is annular and has an outer radial wall 67 in sliding sealed contact with valve body 62 and an inner radial wall that includes inner side 55 of gas seal 53A. Slider 65 includes pressurized gas ports 721 and 72J and exhaust gas ports 72K and 72L. Upper coil spring 69 is disposed around piston tube 81 and has a lower end attached to upper end of slider 65. Lower coil spring 69 is disposed around piston tube 81 and has an upper end attached to lower end of slider 65. Annular seals, such as the six annular seals, shown, between outer radial wall 67 and valve body 62 provide sliding seals between the various ports and chambers.

At the end of the down stroke or pushing movement of piston assembly 80, piston 90A moves slider 65 from the upper or second position shown in FIGS. 5A and 7 to the lower or first position shown in FIG. 6. Piston 90A does not directly strike slider 65 but instead strikes the upper end of coil spring 69, which then moves slider. A slider stop 68, such as a snap ring, interacts between slider 65 and body 62 to stop slider 66 at the lower position or first position wherein pressurized gas port 72I aligns with port 70P in body 62, such that pressurized gas enters chamber 85A below piston 90A for moving piston 90A upward and aligns port 72L with port 72B in body for permitting gases to exhaust via duct 70B from chamber 85B above piston 90B. Some of the pressurized gas entering piston chamber 85A is bled off from port 72C via duct 70C to ports 72D and 72E such that pressurized gas enters chambers 85B, 85C below pistons 90B, 90C for moving piston assembly 80 upward. Duct 70D ducts exhaust gas from ports 72G and 72H above pistons 90A and 90C to port 72F in chamber 85B where it is expelled through duct 70B as stated above.

At the end of the upstroke or the lifting movement of piston assembly 80, piston 90B moves slider 65 from the lower or first position shown in FIG. 6 to the upper or second position shown in FIG. 7. Piston 90B does not directly strike slider 65 but instead strikes the upper end of lower coil spring 69, which then moves slider. A lower slider stop 68, such as a snap ring, interacts between slider 65 and body 62 to stop slider 66 at the upper position or second position wherein pressurized gas port 72J aligns with port 70P in body 62, such that pressurized gas enters chamber 85B above piston 90B for moving piston 90A downward and aligns port 72K with port 72A in body for permitting gases to exhaust through duct 70B from chamber 85A below piston 90B. Some of the pressurized gas entering piston chamber 85B is bled off from port 72F via duct 70D to ports 72G and 72H such that pressurized gas enters chambers 85A, 85C above pistons 90A, 90C for moving piston assembly 80 downward. Duct 70C ducts exhaust gas from ports 72D and 72E below pistons 90B and 90C to port 72C in chamber 85A where it is expelled through duct 70B as stated above.

Because ducts 70C and 70D at valve 61 reverse between pressure and exhaust with every movement, one can see that more pistons could easily be powered by these ducts.

It can be seen that the teachings and principles of the invention are easily adaptable to situations where more or less lifting force is needed. If more force is needed, the gas pressure can be increased, and, if piston diameter is restricted, such as with placement in a well casing, then more pistons can easily be added. If less force is needed, pump 10 can be constructed with one or two pistons. If not as much lifting force is needed, less gas pressure can be used. Also, pump 10, as shown, is easily modified to a two drive piston pump by eliminating end ports 72*g*, 72E and making a passage, such as passages 84, through piston tube 81 below piston 90C such that the lower part of chamber 85C is in fluid communication with the upper part of chamber 85A via the space between piston tube 81 and discharge duct 100. In this manner only pistons 90A and 90B are powered upward and only pistons 90B and 90C are powered downward and the gas above piston 90A and below piston 90C is simply transferred back and forth.

The elements of the invention can be made from well-known materials, such as metal, such as stainless steel or aluminum, and high strength plastics, such as Teflon. Of course, for pumping corrosive liquid, materials not corroded by that liquid should be chosen.

From the foregoing description, it can be seen that pump 10 of the present invention provides a very efficient and reliable manner of pumping liquid. Pump 10 can be placed in a well of any depth and can pump liquids other than water. Pump 10 is particularly maintenance free because the design greatly reduces exposure of seals to abrasion in several manners. First, because pump 10 including collection tube 20 remains stationary during pumping, there is almost no agitation in the well such that little or no debris, such as sand or other grit, is pushed into collection chamber 21. The only movement in the well is liquid entering collection port 24. Second, because the liquid entering collection chamber 21 is going upward, gravity tends to hold abrasive materials downward and away from lower seals 19 and seals 105. No other sliding seals are exposed at all to the liquid. Sturdy check valves are very resistant to wear and are self-cleaning. Pump 10 produces no sparks or ignition sources so that it can be used to pump flammable liquids. To pump liquids very high distances, multiple pumps may be used at spaced intervals. Pump 10 does not mix the gas with the liquid. Although air would commonly be used as the gas, other gases could be used, and probably recycled, when desirable.

Although a particular embodiment of the invention has been illustrated and described, various changes may be made in the form, composition, construction, and arrangement of the parts herein without sacrificing any of its advantages. Therefore, it is to be understood that all matter herein is to be interpreted as illustrative and not in any limiting sense, and it is intended to cover in the appended claims such modifications as come within the true spirit and scope of the invention.

I claim:

1. A submersible pump for connection to a discharge tube having a lower end including an entrance; said pump for pumping a liquid into the entrance of the discharge tube; said pump including:

a wet portion for disposition in the liquid including:

a collecting tuba defining a collection chamber for collecting the liquid; said collecting tube including:

an upper end; and a lower end including:

a collection port for ingress of the liquid into said collection chamber; and a collection valve having open and closed positions that open and close said collection port; and a pumping tube for pumping the liquid; said pumping tube defining a lifting chamber; said pumping tube having a longitudinal axis and including:

an upper end including an egress orifice for ingress of lifted liquid into the discharge tube;

a lower end including:

an ingress port for ingress of liquid from said collection chamber; and an ingress valve having open and closed positions that open and close said ingress port; said pumping tube adapted for reciprocating, longitudinal, sealed, and sliding lifting and pushing movements with the discharge tube and with said collecting tube; the lifting movement being from a lower position, wherein said pumping tube lower end is within said collecting tube and distal the entrance of the discharge tube and said ingress valve is closed, to an upper position, wherein said pumping tube lower end is proximal the entrance of the discharge tube, such that liquid within said lifting chamber is lifted into the entrance of the discharge tube and liquid flows into said collection chamber through said collection port; the pushing movement being from the upper position, wherein said collection valve is closed, to the lower position such that, due to displacement by said pumping tube, a first volume of liquid is forced from said collection chamber through said ingress port, through said pumping tube, and into the entrance of the discharge tube and a second volume of liquid from said collection chamber passes through said ingress port into said lifting chamber; and reciprocating means fix reciprocating said pumping tube.

2. The submersible pump of claim 1 wherein:

said collection valve is closed by gravity.

3. The submersible pump of claim 1 wherein:

said ingress valve is closed by gravity.

4. The submersible pump of claim 1 wherein:

said collection valve is closed by gravity; and said ingress valve is closed by gravity.

5. The submersible pump of claim 1 wherein: said reciprocating means comprising:

a pressurized gas source;

a casing assembly including:

a casing tube connected to the discharge tube; said casing tube having a longitudinal axis; and gas valve means connected to said casing tube and to said pressurized gas source for receiving pressurized gas therefrom; said gas valve means movable between a first valve position and a second valve position; and a piston assembly including:

a piston tube connected to said pumping tube for reciprocating said pumping tube; said piston tube having a longitudinal axis and disposed in co-axial relationship to said casing tube; and an annular piston including:

a first radial wall connected to said piston tube;

a second radial wall in sealed sliding contact with said casing tube above said gas seal;

an upper surface; and a lower lateral face; said piston assembly adapted for reciprocating, longitudinal, sealed, and sliding movements with said casing tube including a lifting movement between a lower position and a higher position whereby said pumping tube is lifted and a pushing movement between the higher position and the lower position whereby said pumping tube is loaded; and wherein: said gas valve means in the first valve position directs pressurized gas against said lower lateral face of said piston in the lower position to push said piston assembly to the higher position.

6. The submersible pump of claim 5 wherein:

said gas valve means in the first valve position exhausts gas from above said piston during the lifting movement.

7. The submersible pump of claim 6 wherein:

said gas valve means in the second valve position exhausts gas from below said piston during the pushing movement.

8. The submersible pump of claim 6 wherein:

said gas valve means in the second valve position directs pressurized gas against said upper lateral face of said piston in the upper position to push said piston assembly to the lower position.

9. The submersible pump of claim 8 wherein:

said gas valve means m the second valve position exhausts gas from below said piston during the pushing movement.

10. The submersible pump of claim 5 wherein:

said gas valve means in the second valve position exhausts gas from below said piston during the pushing movement.

11. The submersible pump of claim 10 wherein:

said gas valve means m the second valve position directs pressurized gas against said upper lateral face of said piston in the upper position to push said piston assembly to the lower position.

12. The submersible pump of claim 5 wherein:

said gas valve means in the second valve position directs pressurized gas against said upper lateral face of said piston in the upper position to push said piston assembly to the lower position.

13. The submersible pump of claim 12 wherein:

said gas valve means in the second valve position exhausts gas from below said piston during the pushing movement.

14. The submersible pump of claim 5 wherein:

said gas valve means includes:

a valve including a movable valve member; and wherein said piston assembly moves said movable valve to the first valve position by pushing movement of said piston assembly and wherein piston assembly moves said movable valve to the second valve position by lilting movement of said piston assembly.

15. The pump of claim 1 wherein:

said reciprocating means comprises:

a pressurized gas source for supplying a pressurized gas a casing assembly including:

a casing tube connected to the discharge tube; said casing tube having a longitudinal axis;

one or more gas seals connected to said casing tube; and gas valve means connected to said casing tube and to said pressurized gas source for receiving pressurized gas therefrom; said gas valve means movable between a first valve position and a second valve position; and a piston assembly including:

a piston tube connected to said pumping tube for reciprocating said pumping tube; said piston tube having a longitudinal axis and disposed in co-axial relationship to said casing tube; and a plurality of annular pistons; each said piston including:

a first radial wall connected to said piston tube;

a second radial wall in sealed sliding contact with said casing tube above said gas seal;

an upper lateral face; and a lower lateral face; said piston assembly adapted for reciprocating, longitudinal, sealed, and sliding movements with said casing tube between a lower position and a higher position; and wherein at least one said gas seal provides sealed sliding contact with said piston tube between said pistons; and said gas valve means in the first valve position directs pressurized gas against said lower lateral faces of said pistons in the lower position to lift said piston assembly to the higher position.

16. The submersible pump of claim 15 wherein:

said gas valve means in the first valve position exhausts gas above said pistons during the lifting movement.

17. The submersible pump of claim 16 wherein:

said gas valve means in the second valve position exhausts gas below said pistons during the pushing movement.

18. The submersible pump of claim 16 wherein:

said gas valve means in the second valve position directs pressurized gas against said upper lateral faces of said pistons in the upper position to push said piston assembly to the lower position.

19. The submersible pump of claim 18 wherein:

said gas valve means in the second valve position exhausts gas below said pistons during the pushing movement.

20. The submersible pump of claim 15 wherein:

said gas valve means in the second valve position exhausts gas below said pistons during the pushing movement.

21. The submersible pump of claim 20 wherein:

said gas valve means in the second valve position directs pressurized gas against said upper lateral faces of said pistons in the upper position to push said piston assembly to the lower position.

22. The submersible pump of claim 15 wherein:

said gas valve means m the second valve position directs pressurized gas against said upper lateral faces of said pistons in the upper position to push said piston assembly to the lower position.

23. The submersible pump of claim 22 wherein:

said gas valve means in the second valve position exhausts gas below said pistons during the pushing movement.

24. A submersible pump for connection to a discharge tube having a lower end including an entrance; said pump for pumping a liquid into the entrance of the discharge tube; said pump including:

a wet portion for disposition in the liquid including:

a collecting tube defining a collection chamber for collecting the liquid; said collecting tube including:

an upper end; and a lower end including;

a collection port for ingress of the liquid into said collection chamber; and a collection valve having open and closed positions that open and close said collection port; and a pumping tube for pumping the liquid; said pumping tube defining a lifting chamber; said pumping tube having a longitudinal axis and including:

an upper end including an egress orifice for egress of lifted liquid into the discharge tube;

a lower end including:

an ingress port for ingress of liquid from said collection chamber; and an ingress valve having open and closed positions that open and close said ingress port; said pumping tribe adapted for reciprocating, longitudinal, sealed, and sliding lifting and pushing movements with the discharge tube and with said collecting tube; the lifting movement being from a lower position, wherein said pumping tube lower end is within said collecting tube and distal the entrance of the discharge tube and said ingress valve is closed, to an upper position, wherein said pumping tube lower end is proximal the entrance of the discharge tube, such that liquid within said lifting chamber is lifted into the entrance of the discharge tube and liquid flows into said collection chamber through said collection port; the pushing movement being from the upper position, wherein said collection valve is closed, to the lower position such that, due to displacement by said pumping tube, a first volume of liquid is forced from said collection chamber through said ingress port, through said pumping tube, and into the entrance of the discharge tube and a second volume of liquid from said collection chamber passes through said ingress port into said lifting chamber; and reciprocating means for reciprocating said pumping tube; wherein: said pumping tube is adapted to displace a volume of said collection chamber during the pushing movement of approximately twice the volume of liquid lifted into the entrance of the discharge tube during the lifting movement.

25. A submersible pump for connection to a discharge tube having a lower end including an entrance; said pump for pumping a liquid into the entrance of the discharge tube; said pump including:

a wet portion for disposition in the liquid including:

a collecting tube defining a collection chamber for collecting the liquid; said collecting tube including: an upper end; and a lower end including:

a collection north for ingress of the liquid into said collection chamber; and a collection valve having open and closed positions that open and close said collection port; and a pumping tube for pumping the liquid; said pumping tube defining a lifting chamber; said pumping tube having a longitudinal axis and including:

an upper end including an ingress port for ingress of lifted liquid into the discharge tube;

a lower end including:

an ingress port for ingress of liquid from said collection chamber; and an ingress valve having open and closed positions that open and close said ingress port; said pumping tube adapted for reciprocating, longitudinal, sealed, and sliding lifting and pushing movements with the discharge tube and with said collecting tube; the lifting movement being from a lower position, wherein said pumping tube lower end is within said collecting tube and distal the entrance of the discharge tube and said ingress valve is closed, to an upper position, wherein said pumping tube lower end is proximal the entrance of the discharge tube, such that liquid within said lifting chamber is lifted into the entrance of the discharge tube and liquid flows into said collection chamber through said collection port; the pushing movement being from the upper position, wherein said collection valve is closed, to the lower position such that, due to displacement by said pumping tube, a first volume of liquid is forced from said collection chamber through said ingress port, through said pumping tube, and into the entrance of the discharge tube and a second volume of liquid from said collection chamber passes through said ingress port into said lifting chamber; and reciprocating means for reciprocating said pumping tube; wherein: the first volume of liquid is approximately equal to the second volume of liquid.

* * * * *

UNITED STATES PATENT AND TRADEMARK OFFICE

CERTIFICATE OF CORRECTION

PATENT NO. : 7,275,590 B2
APPLICATION NO. : 10/854862
DATED : October 2, 2007
INVENTOR(S) : McClain It is certified that error appears in the above-identified patent and that said Letters Patent is hereby corrected as shown below:

Column 7, Claim 1, line 11: “tuba” should read --tube--
Column 7, Claim 1, line 24: “an egress orifice for ingress” should read --an egress orifice for egress--
Column 7, Claim 1, line 55: “fix” should read --for--
Column 8, Claim 9, line 46: “m” should read --in--
Column 8, Claim 11, line 54: “m” should read --in--
Column 9, Claim 14, line 8: “lilting” should read --lifting--
Column 10, Claim 22, line 7: “m” should read --in--
Column 11, Claim 24, line 41: “tribe” should read --tube--
Column 11, Claim 25, line 13: “north” should read --port--
Column 11, Claim 25, line 22: “an ingress port for ingress” should read --an egress port for egress.--

Signed and Sealed this

Second Day of September, 2008

JON W. DUDAS
*Director of the United States Patent and Trademark Office*